US010941464B1

(12) United States Patent
Agarwal et al.

(10) Patent No.: US 10,941,464 B1
(45) Date of Patent: Mar. 9, 2021

(54) METAL NANOPARTICLE COMPOSITES AND MANUFACTURING METHODS THEREOF BY ULTRASONIC CASTING

(71) Applicants: Arvind Agarwal, Miami, FL (US); Tanaji Paul, Miami, FL (US); Cheng Zhang, Miami, FL (US); Pranjal Nautiyal, Miami, FL (US)

(72) Inventors: Arvind Agarwal, Miami, FL (US); Tanaji Paul, Miami, FL (US); Cheng Zhang, Miami, FL (US); Pranjal Nautiyal, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/916,190

(22) Filed: Jun. 30, 2020

(51) Int. Cl.

| | |
|---|---|
| ***C22C 1/02*** | (2006.01) |
| ***C22C 1/10*** | (2006.01) |
| ***C22C 29/16*** | (2006.01) |
| ***B22D 27/00*** | (2006.01) |

(52) U.S. Cl.
CPC ..... *C22C 1/1068* (2013.01); *B22D 27/00* (2013.01); *C22C 1/026* (2013.01); *C22C 29/16* (2013.01)

(58) Field of Classification Search
None
See application file for complete search history.

(56) References Cited

U.S. PATENT DOCUMENTS

| | | | | |
|---|---|---|---|---|
| 7,509,993 | B1 * | 3/2009 | Turng | B82Y 30/00 164/97 |
| 8,206,674 | B2 | 6/2012 | Smith et al. | |
| 2012/0315399 | A1 * | 12/2012 | Feng | C22C 32/0031 427/292 |
| 2013/0199339 | A1 * | 8/2013 | Li | C22B 9/00 75/708 |
| 2017/0204500 | A1 * | 7/2017 | Li | C22C 23/04 |
| 2017/0275742 | A1 * | 9/2017 | Ganor | C22C 38/105 |
| 2017/0355021 | A1 | 12/2017 | Agarwal et al. | |

FOREIGN PATENT DOCUMENTS

| | | |
|---|---|---|
| CN | 102943223 | 2/2013 |
| CN | 106350695 | 1/2017 |
| CN | 109666816 | 4/2019 |
| JP | 2019183281 | 10/2019 |

OTHER PUBLICATIONS

Melania Antillon et al., Strengthening in Boron Nitride Nanotube Reinforced Aluminum Composites Prepared by Roll Bonding, Adv. Eng. Mater. 2018, 20, 1800122.

(Continued)

*Primary Examiner* — George Wyszomierski
(74) *Attorney, Agent, or Firm* — Saliwanchik, Lloyd & Eisenschenk

(57) ABSTRACT

Metal-nanoparticle composites, such as metal-boron nitride nanoparticle composites, and methods of manufacturing the same are provided. Ultrasonic casting techniques can be used to achieve uniform dispersion of nanoparticles, such as boron nitride nanotubes (BNNTs) in a metal matrix, such as aluminum. The BNNTs can be incorporated into the melt of the metal, and ultrasonic treatment can then be applied.

17 Claims, 11 Drawing Sheets

(56) References Cited

OTHER PUBLICATIONS

Pranjal Nautiyal et al., Reactive wetting and filling of boron nitride nanotubes by molten aluminum during equilibrium solidification, Acta Matrialia, 126 (2017) 124-131.
Pranjal Nautiyal et al., Directionally Aligned Ultra-Long Boron Nitride Nanotube Induced Strengthening of Aluminum-Based Sandwich Composite, Advanced Engineering Materials, 2016, 18, No. 10.
T. Laha et al., Tensile properties of carbon nanotube reinforced aluminum nanocomposite fabricated by plasma spray forming, Composites: Part A 40 (2009) 589-594.
Archana Loganathan et al., Effect of 2D WS2 Addition on Cold-Sprayed Aluminum Coating, J Therm Spray Tech (2017) 26: 1585-1597.
Arvind Agarwal et al., Net Shape Nanostructured Aluminum Oxide Structures Fabricated by Plasma Spray Forming, ASM International, Journal of Thermal Spray Technology 350—vol. 12(3) Sep. 2003.

* cited by examiner

METAL NANOPARTICLE COMPOSITES AND MANUFACTURING METHODS THEREOF BY ULTRASONIC CASTING

BACKGROUND

Metal materials can be reinforced with filler particles to increase their strength, providing metal-filler composites. Such composites are manufactured by a variety of methods but typically require chemical and/or mechanical pre-treatment of the filler material. In addition, the filler material often agglomerates together within the metal matrix, limiting its effectiveness.

BRIEF SUMMARY

Embodiments of the subject invention provide novel and advantageous metal (e.g., aluminum (Al))-nanoparticle composites and methods of manufacturing the same. Ultrasonic techniques can be used to achieve superior dispersion of nanoparticles, including SiC nanoparticles and/or one-dimensional (1D) fibrous boron nitride nanotubes (BNNTs) in the metal matrix of the aluminum (e.g., by incorporating into the Al melt). This can result in fine-grained, dense, and high strength nanocomposites.

In an embodiment, a method of fabricating a metal-nanoparticle composite can comprise: preparing a cavity inside a block of a metal; disposing nanoparticles in the cavity to provide a nanoparticle-metal block; melting the nanoparticle-metal block to provide a molten material; stirring the molten material to provide a stirred melt; ultrasonically treating the stirred melt to provide an ultrasonically-treated melt; and cooling the ultrasonically-treated melt (e.g., in an ambient environment) to provide the metal-nanoparticle composite. The nanoparticles can be, for example, BNNTs. The metal can be, for example, Al, an Al alloy, magnesium (Mg), or an Mg alloy. The ultrasonically treating of the stirred melt can comprise inserting a probe in the stirred melt to ultrasonically treat the stirred melt at a controlled amplitude and a controlled frequency for a predetermined period of time. The controlled amplitude can be in a range of from 10 micrometers (μm) to 30 μm, the period of time being in a range of from 10 seconds (s) to 120 s, and the controlled frequency can be in a range of from 18 kilohertz (kHz) to 20 kHz. A tip of the probe configured to be inserted in the stirred melt can have a length in a range of from 4 millimeters (mm) to 8 mm. The melting of the nanoparticle-metal block comprising melting the nanoparticle-metal block in a crucible placed in a furnace at a predetermined temperature (e.g., 660° C. to 750° C.). The nanoparticles can be pure nanoparticles that have not undergone any chemical pre-treatment or mechanical pre-treatment prior to being disposed in the cavity. The cavity can have a diameter in a range of from 20 mm to 30 mm and/or a height in a range of from 15 mm to 20 mm. The nanoparticles can be disposed in the cavity such that a volume percentage of the nanoparticles in the nanoparticle-metal block is in a range of from 0.5% to 5% (e.g., 0.5% to 2%). The nanoparticles can be BNNTs, the BNNTs in the metal-nanoparticle composite having an aspect ratio in a range of from 10,000 to 30,000, and/or the BNNTs can be uniformly dispersed within the metal in the metal-nanoparticle nanocomposite.

In another embodiment, a metal-BNNT composite can comprise pure BNNTs (i.e., from BNNTs that were not chemically and/or mechanically pre-treated prior to be added to the metal) uniformly dispersed within a matrix of the metal. The BNNTs within the metal matrix can have an aspect ratio in a range of from 10,000 to 30,000. The metal-BNNT composite can be formed by in situ ultrasonic casting as disclosed herein. The metal can be, for example, Al, an Al alloy, magnesium (Mg), or an Mg alloy.

BRIEF DESCRIPTION OF DRAWINGS

FIG. 2(*b*) is a plot showing strengthening due to carbon nanotube addition. This image is from Laha et al. ("Tensile Properties of Carbon Nanotube Reinforced Aluminum Nanocomposite Fabricated by Plasma Spray Forming" Composites Part A: Applied Science and Manufacturing 40 (2009) p 589-594; which is hereby incorporated by reference herein in its entirety).

FIG. 3(*b*) is a plot showing enhancement in microhardness due to nanoparticle addition. This image is from Loganathan et al. (supra.).

FIG. 4(*b*) is a microscopic image showing uniform dispersion of nanoparticles in plasma spray deposited alumina components. This image is from Agarwal et al. (supra.).

FIG. 6(*b*) is a microscopic image of the Al alloy of FIG. 6(*a*), but after sonication treatment at 700° C. for 30 seconds (s).

FIG. 6(*c*) is a plot showing grain size (in μm) and microhardness (in Vickers hardness number (HV)) for the as cast Al alloy ("as cast"), after 15 s of sonication treatment ("US, 15 s"), and after 30 s of sonication treatment ("US, 30 s"). The dashed line that increases from left to right (with the higher value for the US, 30 s alloy) is for the microhardness, and the dashed line that decreases from left to right (with the lower value for the US, 30 s alloy) is for the grain size.

FIG. 6(*d*) is an X-ray diffraction (XRD) plot of ultrasonically cast Al alloy (Al 6061) revealing no $Al_2O_3$ peak (on top surface as well as the middle section of the cast pellet, i.e., 3 millimeters (mm) below the top surface). The ultrasonic processing was performed at 750 Watts (W) power, 20 μm amplitude.

FIG. 7(*b*) is an image and corresponding SEM micrograph of a sectioned plane of the solidified Al alloy-BNNT composite pellets of FIG. 7(*a*), but after being subjected to ultrasonic treatment for 15 s at 700° C., 20 μm amplitude and applied power of 700 W. The scale bar on the SEM micrograph is 1 μm. The images show no BNNT clusters. The inset of the SEM micrograph shows a single BNNT in the Al matrix, verifying sonication induced dispersion.

FIG. 9(*b*) is a two-dimensional (2D) contour map post image processing, showing CNT dispersion.

FIG. 10(*b*) is a construction of triangles using the points from FIG. 10(*a*).

FIG. 14(*b*) is high resolution transmission electron microscope (HRTEM) image showing trace amounts of interfacial product formation on the composite of FIG. 14(*a*). The scale bar in the lower-left of the main image is 2 nm.

DETAILED DESCRIPTION

Embodiments of the subject invention provide novel and advantageous aluminum (Al)-nanoparticle composites and methods of manufacturing the same. Ultrasonic techniques can be used to achieve superior dispersion of nanoparticles, including SiC nanoparticles and/or one-dimensional (1D) fibrous boron nitride nanotubes (BNNTs) in the metal matrix of the aluminum (e.g., by incorporating into the Al melt). This can result in fine-grained, dense, and high strength nanocomposites.

No related art methods exist to manufacture an Al matrix composite reinforced with a homogeneous distribution of high surface area BNNTs by casting. Embodiments of the subject invention fill this gap by providing methods to rapidly manufacture Al matrix composites reinforced with a uniform distribution of pure, high surface area BNNTs by ultrasonic casting. Such methods enhance the integration of the BNNTs by in situ, one-step anchoring with Al, while also preserving the pristine structural morphology of the BNNTs, enabling excellent flexibility for manufacturing a wide range of metal and alloy matrix composites, and saving time and money. These advantages provide the ability to manufacture a component that can bear the same load (as a pure Al component) using a lower volume of material. Embodiments thus provide alternative, green technology for fabrication of lightweight, high strength components with lower fuel consumption and carbon footprint, to be used in a variety of applications including but not limited to aerospace and automotive components.

Figures 14A, 14B:
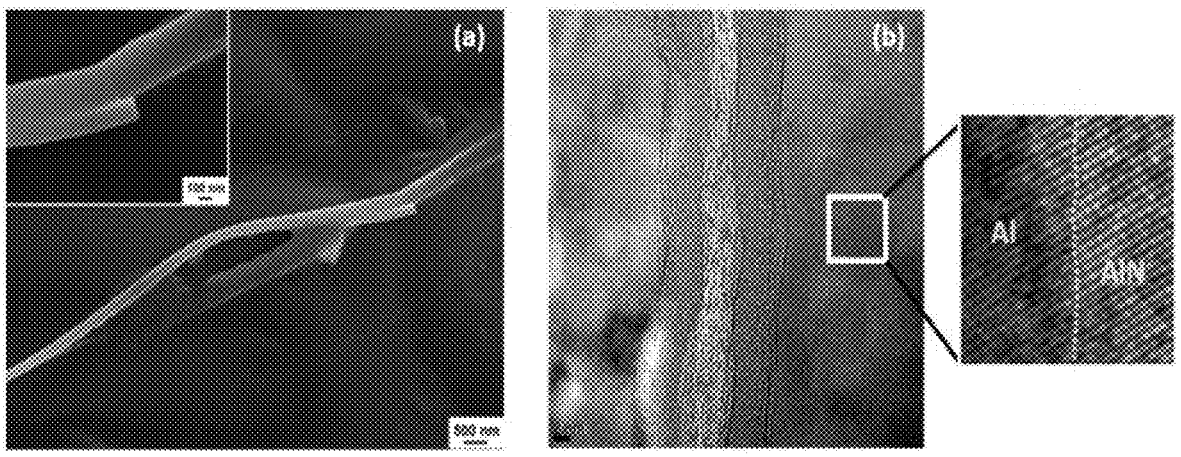
FIG. 14(*a*) is an SEM image showing survival and integration of BNNTs in an Al matrix after solidification. The scale bar is 500 nanometers (nm) for the main image and 100 nm for the inset.
Figure 15:
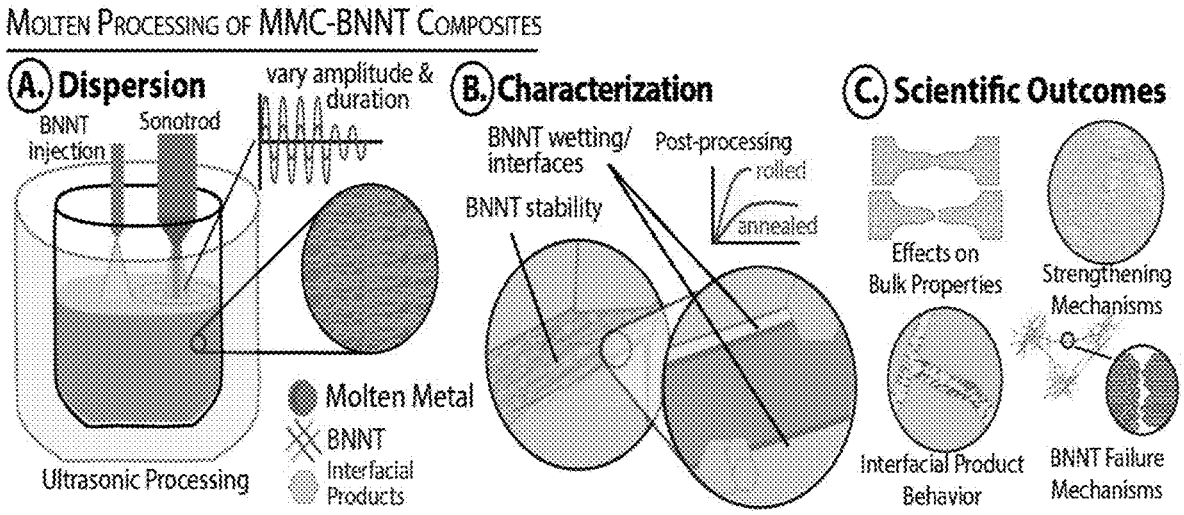
FIG. 15 is a schematic for processing of metal matrix-BNNT composites of embodiments of the subject invention.

In many embodiments, BNNTs can be incorporated into a metal matrix (e.g., an Al matrix) by ultrasonic cavitation. BNNT is a one-dimensional (1D) nanomaterial comprising hexagonal boron nitride (h-BN) sheets wrapped in a tubular form, analogous to carbon nanotubes (CNTs). BNNTs display extraordinary mechanical properties (elastic modulus >1 teraPascal (TPa) and tensile strength up to about 61 gigaPascal (GPa)). BNNTs also exhibit high flexibility, with double the fracture strain of CNTs. A major advantage of BNNTs over CNTs is the thermal stability up to 1000° C., compared to the fact that CNTs start oxidizing at 450° C. High-temperature stability of BNNTs can enable processing of low melting point metals such as Al and Mg by the solidification route because BNNTs are stable at temperatures exceeding their melting points. Also, BNNTs display extraordinary thermal conductivity, piezoelectric behavior, chemical stability against acids and bases, and ability to suppress neutron radiation. Therefore, BNNTs are a promising material to develop multifunctional nanocomposites for advanced military and civil applications. Long nanotubes can be used for effective stress transfer from the metal matrix to the filler (shear-lag mode). BNNT can be used as a reinforcing filler phase for Al-based metal matrix composites. A very limited interfacial reaction takes place to form ultra-thin AlN layer, which promotes interfacial wetting of nanotubes (see also FIGS. 14(*a*) and 14(*b*)). The limited reaction improves the interface adhesion due to the formation of covalent bonds, increasing its desirability for effective integration of nanotubes. Due to the low chemical reactivity of BNNTs, the thickness of the reaction product formed at the interface is about 2-3 nm. FIG. 15 is a schematic for processing of metal matrix-BNNT composites of embodiments of the subject invention.

Embodiments of the subject invention allow rapid production of Al matrix composites reinforced with a uniform distribution of nanoparticles (e.g., SiC nanoparticles or BNNTs) by ultrasonic casting. Superior in situ, one-step anchoring of individual nanoparticles with the Al matrix is achieved by harnessing controlled interfacial reactions between the two. Preservation of the purity of high surface area BNNTs can enable full utilization of the strength and thermal stability of the reinforcement. The resulting composites have good material flexibility for manufacturing lightweight, high strength Al-nanoparticle composites.

Figure 1:
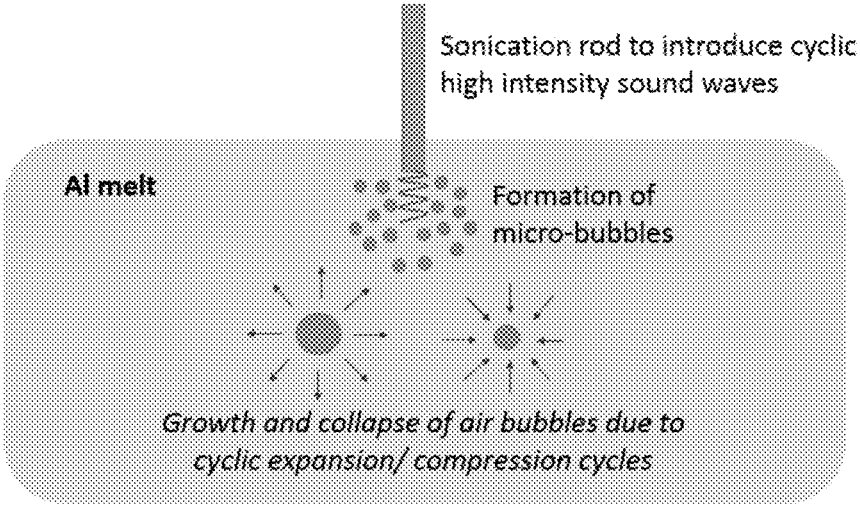
FIG. 1 is a schematic representation of the underlying principle of ultrasonic cavitation.

FIG. 1 is a schematic representation of the underlying principle of ultrasonic cavitation. With respect to BNNTs as the nanoparticles used, a uniform distribution of high surface area BNNTs within the molten Al matrix can be achieved. The purity of the BNNTs is preserved and their integration with the matrix is enhanced simultaneously. Maximal utilization of the beneficial properties of BNNTs can thus be achieved.

Referring still to FIG. 1, cyclic high-intensity sound waves can be introduced into the melt pool by ultrasonication, creating thousands of microbubbles. These bubbles act as nucleation sites for metal solidification. Ultrasonic processing leads to smaller grain size, arrested grain branching and equiaxed grains. Cavitation also causes the growth of hydrogen gas ($H_2$ gas) bubbles dissolved in the Al melt due to rapid diffusion. These bubbles then coalesce to the size required for their floatation to the top surface of the melt, resulting in an increased density in the solidified metal. Therefore, ultrasonically cast alloys can exhibit superior strength. Additionally, ultrasonic casting produces a "non-dendritic" microstructure due to accelerated solidification, contrary to a dendritic microstructure in related art metal casting. The oscillating cavitation bubbles cause fragmentation of growing dendrites. The resultant globular microstructure results in enhanced ductility. Therefore, metal matrix composites processed by ultrasonic cavitation can result in simultaneous enhancement of strength and ductility.

Effective dispersion is a key challenge in nanocomposite processing. Adhesion, capillary, and van der Waals forces hold together the nanoparticles as agglomerates. The strength of the agglomerates is given as:

$$\frac{P}{Ar} = \frac{f_v}{1 - f_v}\frac{F}{d^2} \tag{1}$$

where P is the total force of binding, Ar is the cross-section area of the agglomerate, $f_v$ is the volume fraction of the particle in the agglomerate, F is the interparticle binding force and d is the average diameter of the particle. In nanocomposites, the size of the particles (d) is extremely small (1-100 nanometers (nm)). As a result, binding forces are very high, and dispersion is not as easy as in the case of micron-size particles. Ultrasonic cavitation produces high-intensity acoustic waves with alternating compression-expansion cycles, resulting in the formation and collapse of microbubbles in the melt (see also FIG. 1). The explosion of bubbles produces high-temperature hot spots, where localized pressures can reach up to 1000 atmosphere (atm) and heating/cooling rates can surpass $10^6$ Kelvin per second (K/s). This implosive impact breaks up clustered nanoparticles in the melt and assists in their uniform dispersion in the matrix.

In aerospace and automotive components, Al is the most widely used among commercial light metals. In order to lower fuel consumption in these applications, the weight of the components needs to be reduced without compromising their load-bearing capability. This requires a material with higher strength per unit weight or higher specific strength. BNNTs, exhibiting high strength (about 61 gigaPascals (GPa)) and low density (0.3-2.0 grams per cubic centimeter (g/cc)), are a promising candidate to reinforce the Al matrix for the fabrication of high specific strength composites. Embodiments of the subject invention can manufacture an advanced BNNT reinforced Al matrix composite within minutes (e.g., 45 minutes or less, 40 minutes or less, 35 minutes or less, 30 minutes or less, 25 minutes or less, 20 minutes or less, 15 minutes or less, or even 10 minutes or less).

Embodiments of the subject invention provide several advantages over the related art. Homogenous dispersion of high surface area BNNTs in the Al matrix can be achieved using ultrasonic casting. Ultra-long BNNTs would be expected to entangle and agglomerate in molten Al due to the strong mutual attraction between their surfaces known as van der Waals forces. In embodiments of the subject invention, the BNNTs are disentangled into individual BNNTs by administering high-intensity ultrasound waves that overcome the attractive forces. The waves subsequently propagate throughout the melt, thereby distributing the BNNTs. Embodiments can therefore result in dispersing BNNTs with an extremely high aspect ratio (e.g., 10,000-30,000) by ultrasonic casting, where the aspect ratio is the length divided by the width (e.g., width when viewed from side) or the length divided by the diameter. The aspect ratio of reinforcements dispersed by related art technologies range from 400-1,000 for Carbon Nanotubes (CNTs) to 200-5,000 for BNNTs. Embodiments of the subject invention surpass these by a factor of 20-150.

Enhanced integration between the BNNTs and the Al matrix is achieved by ultrasonic casting. A large area of interface can be created between the BNNTs and Al, and a large number of locations are thus generated, which drives in situ reactions between BNNTs and Al. The resulting enhancement of interfacial bonding enables the transfer of load from the metal matrix to the stronger reinforcement. Therefore, the maximum interphase strengthening potential of the BNNTs is utilized.

In related art methods, nanotube reinforcements such as CNTs and BNNTs are always subjected to a highly specialized chemical and/or mechanical pre-treatment. CNTs are surface coated with chemicals, metal-plated, structurally altered by heat treatment, protected by a layer of oxide, and/or disintegrated by ball milling. BNNTs are compressed into pellets or coated by sputtering. Pre-treatment of reinforcements imposes a major limitation by causing loss or diminishment of the intrinsic properties of the reinforcements. Embodiments of the subject invention overcome these issues by maintaining the pristine structural morphology of the nanoparticle reinforcements (e.g., BNNTs) by ultrasonic casting. That is, the nanoparticle reinforcements (e.g., BNNTs) can be cast with no chemical pre-treatment and no mechanical pre-treatment (i.e., in their pure form).

Embodiments of the subject invention enable superior flexibility in materials for manufacturing lightweight, high strength metal matrix composites. Although Al and Al alloy matrix composites are discussed herein in detail, embodiments are not limited thereto. In addition to Al and Al alloys, the methods of embodiments of the subject invention can be employed to fabricate magnesium (Mg) and Mg alloy matrix composites reinforced with a uniform distribution of pure nanoparticles (e.g., BNNTs). Indeed, the thermal stability of BNNTs up to 1000° C. can be utilized to integrate it with any metal or alloy matrix with a melting point below this temperature. Embodiments can thus be used to fabricate a wide range of BNNT reinforced metal matrix composites.

Embodiments of the subject invention save time and monetary expenditure compared to related art methods and composites. No chemical and/or mechanical pre-treatment of the nanoparticle reinforcement (e.g., BNNTs) is necessary, and such treatments typically require an additional 14-48 hours due to their inherently time-consuming nature. Embodiments of the subject invention provide one-step ultrasonic casting methods that can cut manufacturing time to about 10-30 minutes. The simplicity eliminates the need for specialized instruments and skill, thereby lowering the cost of manufacturing.

Embodiments of subject invention advantageously provide at least the following: disentanglement and uniform distribution of individual, high aspect ratio BNNTs in a molten Al matrix by ultrasonic waves in minutes; harnessing of integral anchoring between BNNTs and Al by in situ interfacial reactions; and preservation of the pristine structure and morphology of BNNTs in an Al-BNNT composite (which can also be referred to as a BNNT-reinforced Al matrix composite).

Figure 5:
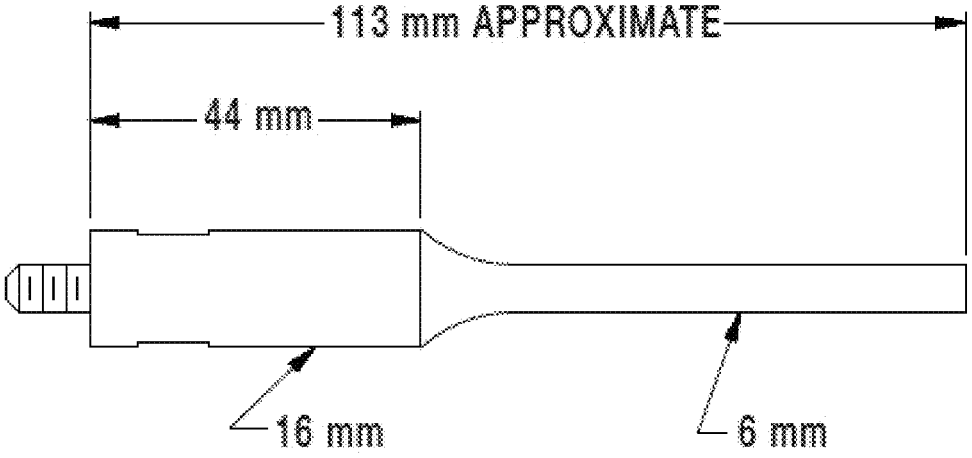
FIG. 5 is a schematic of a special probe (e.g., a niobium (Nb) probe) designed to operate in a temperature range of 575-775° C. Certain dimensions are listed on FIG. 5, but these are for exemplary purposes only and should not be construed as limiting.

In an embodiment, a method of manufacturing a BNNT-reinforced Al matrix composite can include: preparing a cavity inside an Al block (e.g., a cylindrical Al block) and disposing BNNTs inside the cavity; melting the Al and BNNTs and stirring the molten Al; ultrasonically treating the molten Al (e.g., by inserting a probe inside the molten Al); and cooling the ultrasonically treated melt (e.g., in an ambient environment) to provide the BNNT-reinforced Al matrix composite. The cavity can have a diameter of, for example, 20-30 millimeters (mm) and a height of, for example, 15-20 mm. The BNNTs can be, for example, 0.5-2% by volume. The melting of the Al and BNNTs can be done at temperature of, for example, 660-750° C., and this can be done by, for example, melting the Al and BNNTs in a crucible placed inside a furnace operated at the desired temperature. The ultrasonic treatment can include ultrasonically treating the molten Al at a controlled amplitude (e.g., in a range of from 10-30 micrometers (μm)) and/or a controlled frequency (e.g., in a range of from 18-20 kilohertz (kHz)). The ultrasonic treatment can be for a short period of time (e.g., in a range of from 10-120 seconds (s)), and the portion of the probe inserted into the molten Al can have a length of, for example, 4-8 mm. FIG. 5 shows an example of a probe that can be used, and the dimensions listed thereon are for exemplary purposes only and should not be construed as limiting.

Embodiments of the subject invention are advantageous in many applications, including but not limited to applications where lightweight and high strength are the main criteria, such as in aerospace and automotive components. The lightweight nature reduces the consumption of fuel, thereby achieving a significant saving of cost. This is an alternative green and cheaper technology for fabricating fuselage and wings of aircraft and chassis of automobiles. The mainframe and body of aerospace vehicles and automobiles constitute a significant part of their total weight. This weight can be reduced by the methods and composites of embodiments of the subject invention. In addition to lower fuel consumption, the lowered weight will also reduce emissions thereby leading to a smaller carbon footprint of these vehicles. Further, composites of embodiments of the subject invention can be sued used in the development of lightweight and robust unmanned air vehicles (UAVs) and ground vehicles for traversing uneven terrains. BNNTs have excellent thermal conductivity, and therefore, BNNT-based composites can be employed in combat tanks for thermal management by effective dissipation of heat in critical components. BNNTs are also known to exhibit radiation absorption properties, so BNNT based-composites, can be used in radiation shields.

No related art technology exists to manufacture an Al matrix composite reinforced with a homogenous distribution of high surface area BNNTs by casting. Thus, embodiments of the subject invention create a new paradigm for metal matrix composite manufacturing. The in situ anchoring achieved by embodiments of the subject invention eliminates the need for material development and decreases cost and time required.

Figure 2A:
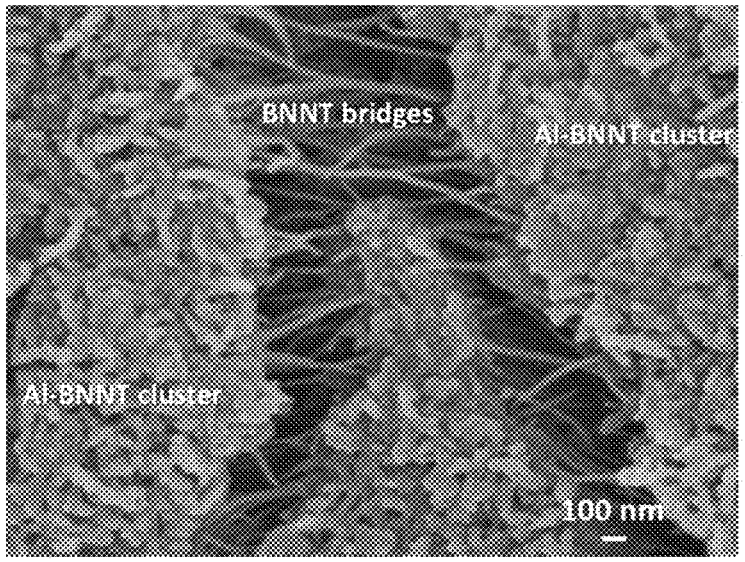
FIG. 2(a) (Prior Art)
FIG. 2(*a*) is a microscopic image of one-dimensional (1D) nanotube reinforced composites. This image is from Nautiyal et al. ("Directionally Aligned Ultra-Long Boron Nitride Nanotube Induced Strengthening of Aluminum-Based Sandwich Composite" Advanced Engineering Materials 18 (2016) p 1747-1754; which is hereby incorporated by reference herein in its entirety).
Figure 2B:
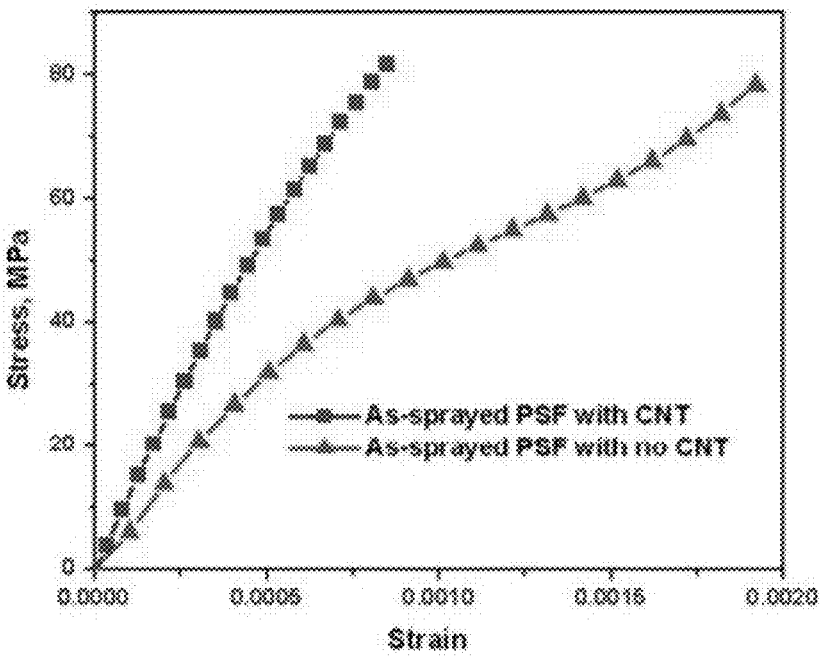
FIG. 2(b) (Prior Art)
Figure 3A:
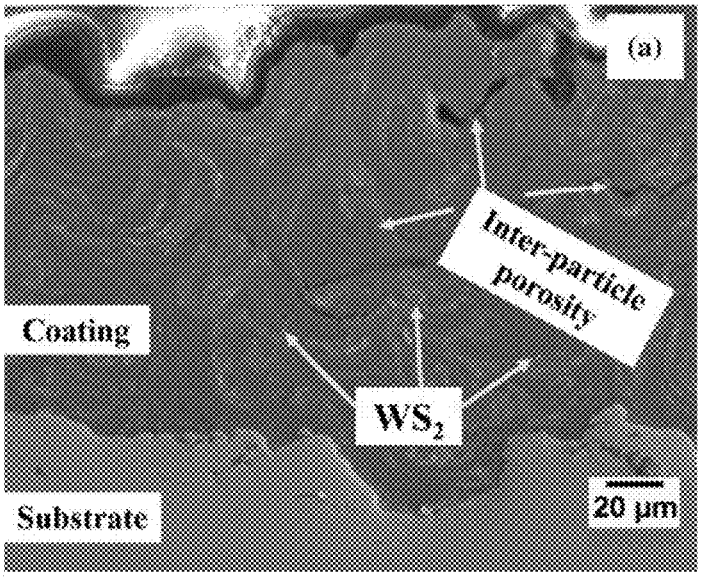
FIG. 3(a) (Prior Art)
FIG. 3(*a*) is a microscopic image of $WS_2$-reinforced coating deposited by cold spray. This image is from Loganathan et al. ("Effect of 2D WS2 Addition on Cold Sprayed Aluminum Coatings" Journal of Thermal Spray Technology 26 (2017) p 1585-1597; which is hereby incorporated by reference herein in its entirety).
Figure 3B:
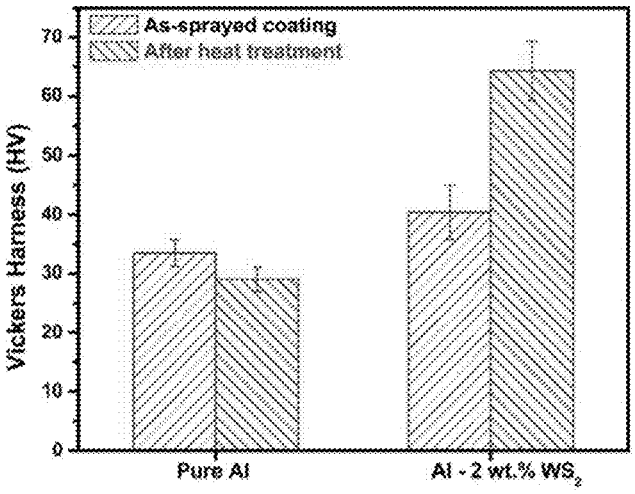
FIG. 3(b) (Prior Art)
Figures 4A, 4B:
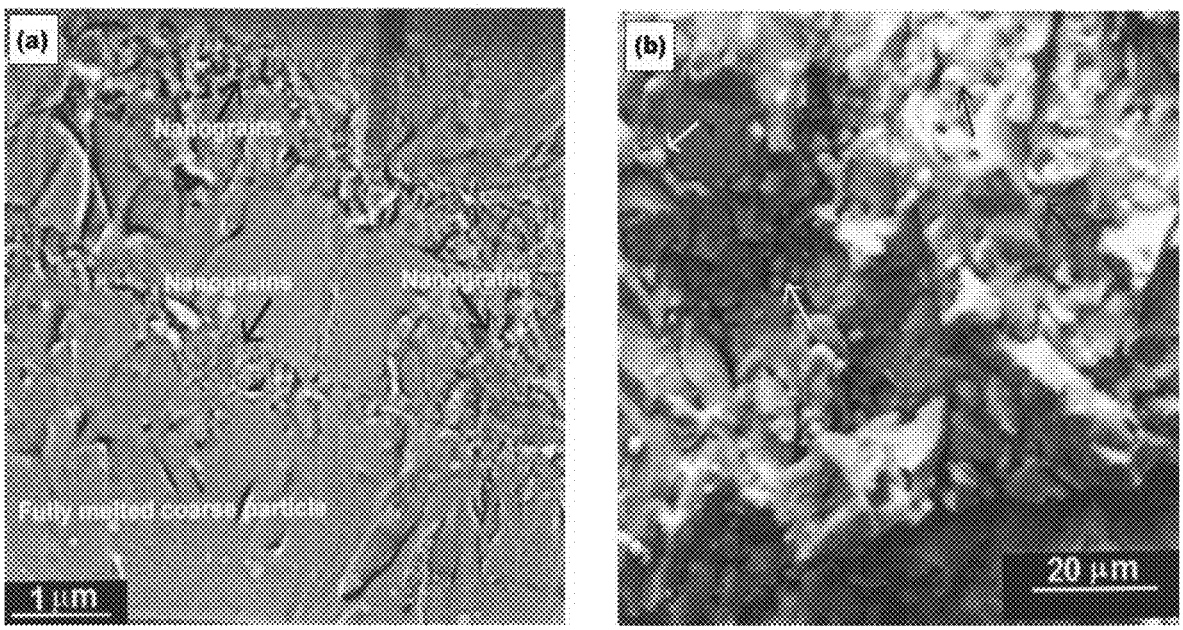
FIGS. 4(a)-4(b) (Prior Art)
FIG. 4(*a*) is a microscopic image of $Al_2O_3$ nanoparticles integrated in free-standing alumina components fabricated by plasma spray. This image is from Agarwal et al. ("Net Shape Nanostructured Aluminum Oxide Structures Fabricated by Plasma Spray Forming" Journal of Thermal Spray Technology 12 (2003) p 350-359; which is hereby incorporated by reference herein in its entirety).

FIG. 2(*a*) is a microscopic image of one-dimensional (1D) nanotube reinforced composites, from Nautiyal et al. (supra.). The Al composite with directionally oriented nanotubes was fabricated by a combination of sputtering, spark plasma sintering (SPS), and cold rolling processes. An enhancement in tensile strength was obtained due to long and aligned nanotubes. The nanotubes act as crack bridges and enhance the overall load-bearing ability of the composite (see also FIG. 2(*b*)). The nanotubes had to be subjected to pre-treatment, though, and are therefore not pure in the composite. FIG. 3(*a*) is a microscopic image of tungsten disulfide ($WS_2$)-reinforced coating deposited by cold spray, and FIG. 3(*b*) is a plot showing enhancement in microhardness due to nanoparticle addition, both from Loganathan et al. (supra.). The solid lubrication properties of two-dimensional (2D) layered $WS_2$ were exploited to enhance the tribological properties of cold sprayed Al composite coatings. The addition of 2 wt % nanoparticles resulted in an improvement in microhardness, and heat treatment of the composite coating further improved the wear resistance, along with a drop in the coefficient of friction. FIG. 4(*a*) is a microscopic image of $Al_2O_3$ nanoparticles integrated in free-standing alumina components fabricated by plasma spray, and FIG. 4(*b*) is a microscopic image showing uniform dispersion of nanoparticles in plasma spray deposited alumina components, both from Agarwal et al. (supra.). Free-standing bulk articles were fabricated by a plasma spray technique, with "nanostructured" $Al_2O_3$ particles in the deposit. The retention of nanoparticles during plasma spray was ascribed to their entrapment between the coarser microparticles during the spray, inhibiting their complete melting and thereby creating nanograins of $Al_2O_3$. These nanoparticles act as mechanical reinforcement, resulting in an improved microhardness value of about 1065 Vickers hardness number (VHN).

The microstructure evolution in ultrasonic cavitation depends on three critical processing parameters: (i) temperature of the melt; (ii) amplitude of the vibration; and (iii) the time of ultrasonic treatment. The addition of nano-species in the melt introduces major challenges to metal/alloy processing, such as chemical reactivity, physical stability, and agglomeration. Higher ultrasonic treatment time leads to grain refinement, and higher sonication time will also result in superior dispersion and limited agglomeration of nanoparticles. However, longer processing time may also lead to accelerated interfacial reactions between metal (e.g., Al) and nanoparticles. The acoustic waves can also damage/alter the nanoparticle morphology, which will compromise their ability to enhance mechanical properties.

The propagation of ultrasound in the melt results in loss of oscillation energy. The amplitude of the acoustic wave drops exponentially with distance x:

$$A=A_o e^{-\alpha x} \tag{2}$$

where $\alpha$ is the attenuation factor and A is the amplitude. Therefore, non-homogeneity in the microstructure is expected, with finer grains in the vicinity of the sonotrode and progressive coarsening of grains away from the sonotrode. Higher amplitude acoustic waves are expected to travel farther before dying.

Higher amplitude of vibration can promote deagglomeration of nanoparticle clusters and reduce the required time duration for sonication, which is desirable for minimizing interfacial reactions. However, high amplitude waves pose the risk of damaging the nanoparticles in the melt.

The sound pressure introduced by the sonotrode must exceed a certain threshold value to initiate cavitation in the melt. The critical radius (Rcr) of the cavitation bubble before its rupture is given as:

$$R_{cr} = \frac{2\sqrt{2\mu}}{\sqrt{3\kappa P_o \rho}} \tag{3}$$

where $\mu$ is the viscosity of the melt, $\kappa$ is a polytropic constant, Po is the initial gas pressure, and $\rho$ is the melt density. The critical radius is directly proportional to the melt viscosity. It is well known that the viscosity of molten Al drops as the temperature of the melt increases. Therefore, the higher temperature would result in lower critical radius and hence favorable cavitation in the melt. However, higher temperature poses the challenge of increased interface reactions between Al and nanoparticles.

Table 1 shows example ultrasonic cavitation parameters that can be used in some embodiments of the subject invention.

TABLE 1

Processing parameters for the ultrasonic casting of Al-based nanocomposites

| Cavitation parameters | Proposed range of investigation |
|---|---|
| Temperature | 600-800° C. |
| Amplitude of vibrations | 5-30 μm |
| Time | 5-60 seconds |

The method of introducing nanoparticles can influence the microstructure, particularly the quality of dispersion. The injection technique can, in turn, be influenced by the nature of nanoparticle (size, morphology, density) and chemical interactions that take place in the melt (reactivity between the metal and nanoparticles). Two example injection methods that can be used include capsulate feeding and pre-melting introduction. Capsulate feeding includes the nanoparticles being wrapped in foil of the metal used (e.g., Al foil for an Al composite). These metal capsules containing nanoparticles can be injected into to the melt through a tube, and sonication treatment can be employed to disperse the nanoparticles. In pre-melting introduction, the nanoparticles can be mixed with the solid metal pieces/chunks in the crucible. This mixture can then be heated to melt the metal, and sonication treatment can be used to disperse the nanoparticles present in the crucible.

Varying the volume fraction of nanoparticles can have an effect on composite microstructure. Adding excessive nanoparticles can lead to agglomeration in the microstructure, which is difficult to overcome, resulting in deteriorated mechanical properties The nanoparticles can be added at a volume percentage of any of the following values, about any of the following values, at least any of the following values, or at most any of the following values (all values are volume percentage of the composite): 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.2, 3.3, 3.4, 3.5, 3.6, 3.7, 3.8, 3.9, 4, 4.1, 4.2, 4.3, 4.4, 4.5, 4.6, 4.7, 4.8, 4.9, 5, 5.5, 6, 6.5, 7, 7.5, 8, 9, or 10.

Figure 8:
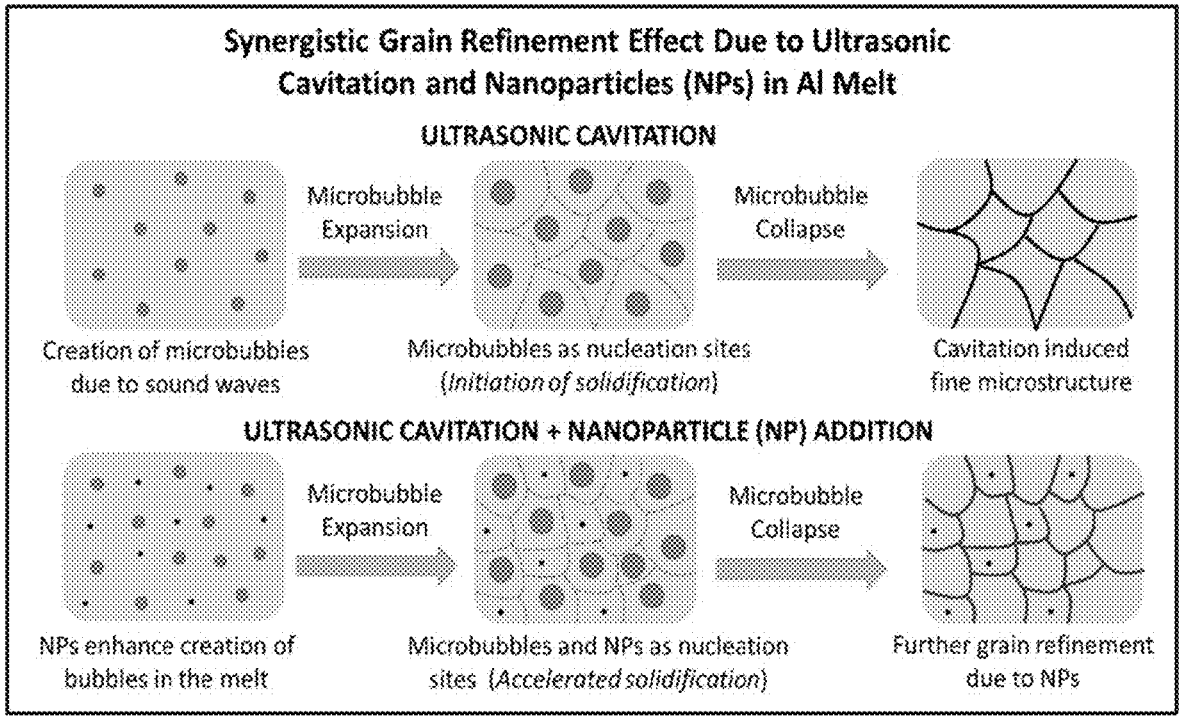
FIG. 8 is a schematic representation of the contribution of cavitation and nanoparticle addition towards grain refinement in metal matrix composites (MMCs).

Ultrasonic cavitation promotes interfacial wetting by stripping off the gaseous species adsorbed on the nanoparticle surface and by forcing the melt into the surface asperities. As a result, these sites filled with molten metal act as active solidification sites. The accelerated wetting of nanoparticles by molten metal can reduce the overall casting time, which can result in arrested interfacial product formation. Cavitation bubbles in the melt act as nucleation sites during solidification. Grain size due to ultrasonic treatment is given by the relation:

$$D_{gr} = 5.6\left(\frac{Dz\Delta T_n}{vQ}\right) + \frac{1}{\sqrt[3]{f(A)N_v}} \tag{4}$$

where D is the diffusion coefficient of the solute in the melt, zΔTn is the incremental amount of undercooling required to activate the nucleation event ahead of the solidification front, v is the growth rate of the solid-liquid interface, Q is the growth restriction factor, Nv is the number density of the substrate, and A is the ultrasonic amplitude. From Equation (4), it is evident that higher amplitude leads to smaller grain size. The higher volume fraction of nanoparticles (higher Nv) would also result in finer grains, due to more heterogeneous nucleation sites. Therefore, cavitation bubbles and nanoparticles in the melt have a synergistic effect on grain refinement. The mechanism of grain refinement during ultrasonic processing of metal matrix composites is schematically shown in FIG. 8.

Cavitation causes the growth of $H_2$ gas bubbles dissolved in the metal melt due to rapid diffusion. These microbubbles then coalesce to form larger bubbles, which can float to the top surface of the melt. The ejection of dissolved gas from the melt results in reduced porosity or denser microstructure. Controlling porosity in the microstructure is important for achieving superior mechanical properties. In turn, porosity in the composite can be a function of ultrasonic processing parameters. The porosity of the composites can be quantified using the Helium Pycnometer and Archimedes Principle.

Figures 9A, 9B:
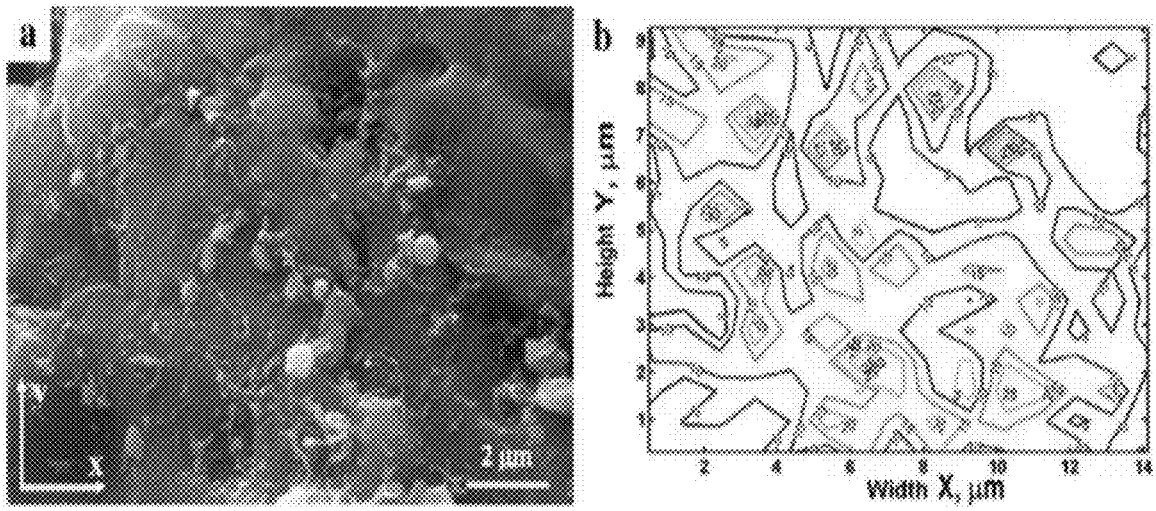
FIG. 9(*a*) is an SEM micrograph showing the fracture surface, showing carbon nanotube (CNT) distribution in the matrix. The scale bar is 2 μm.
Figures 10A, 10B:
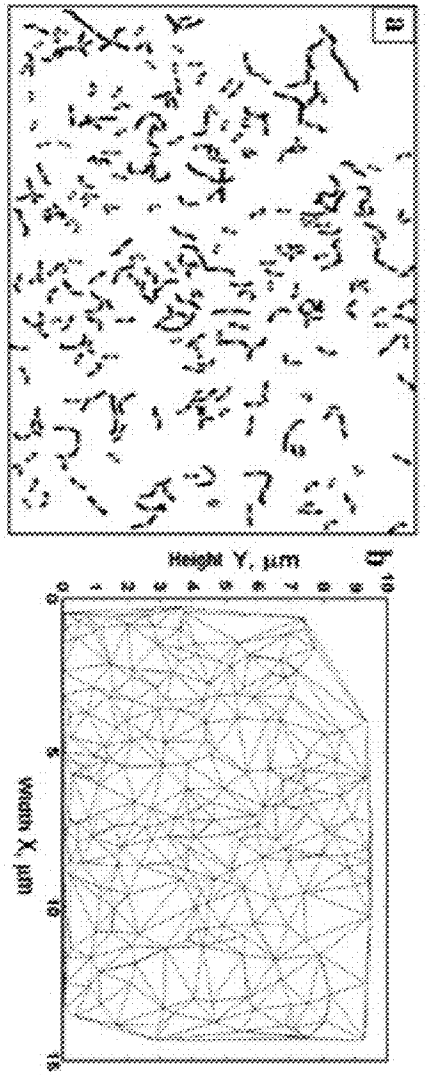
FIG. 10(*a*) is a schematic representation of representative points taken on CNTs for a Delaunay triangulation method to quantify nanoparticle distribution in the matrix.

The quality of nanoparticle (e.g., SiC nanoparticles or BNNTs) dispersion by ultrasonic cavitation technique can be assessed by image analysis and Delaunay triangulation methods. These techniques can also be used for CNT reinforced Al composites. In addition, a standard ASTM index for characterizing the dispersion quality on a relative scale can be computed. In image analysis, a micrograph of the fracture surface with nanoparticles distributed in the Al matrix can be used for evaluating the dispersion quality. This technique involves creating cells in the image and then evaluating the number of particles in each cell (see FIGS. 9(*a*) and 9(*b*)). If the number of nanotubes is more or less similar in all the cells, it signifies the excellent quality of dispersion. The Delaunay triangulation method involves the construction of triangles by connecting a set of points such that no point falls inside the perimeter of any triangle. The edges of the triangles represent the nearest neighbor distance. Delaunay triangulation of Al—SiC and Al-BNNT microstructure by considering the center of each nanoparticle as a point can be a measure of the quality of nanoparticle dispersion (see also FIGS. 10(*a*) and 10(*b*)). A larger value of the mean polygon edge length signifies less clustering, and the smaller the standard deviation for polygon edge lengths, the more uniform is the dispersion of nanoparticles in the matrix. In order to compute the ASTM dispersion index, the SEM micrograph can be divided into nine equal-sized sections. These sections are divided into 10,000 squares, and the average number of squares that are at least half occupied by nanoparticles in these sections are determined as U. An ASTM Dispersion Index, D, is then calculated as:

$$D = 100 - \frac{U}{L} \tag{5}$$

where L is the volume fraction of the nanoparticles. This index varies from 0 to 100, where 100 signifies excellent dispersion.

The mechanical properties of nanocomposites are highly sensitive to the microstructure variables, such as dispersion, grain size, and porosity. Therefore, connecting ultrasonic processing variables with mechanical properties is important for engineering nanocomposites with desired performance. Grain refinement due to cavitation as well as the addition of nanoparticle reinforcement can improve the mechanical properties of the composites significantly. Usually, the addition of a ceramic nano-filler to a metal matrix leads to arrested ductility, but ultrasonic casting produces a "non-dendritic" microstructure due to accelerated solidification, contrary to a dendritic microstructure in related art metal casting. The oscillating cavitation bubbles cause fragmentation of growing dendrites. The resultant globular microstructure results in enhanced ductility. Therefore, metal matrix composites processed by ultrasonic cavitation may result in simultaneous enhancement of strength and ductility, which is advantageous and in general would not be expected.

Figure 11:
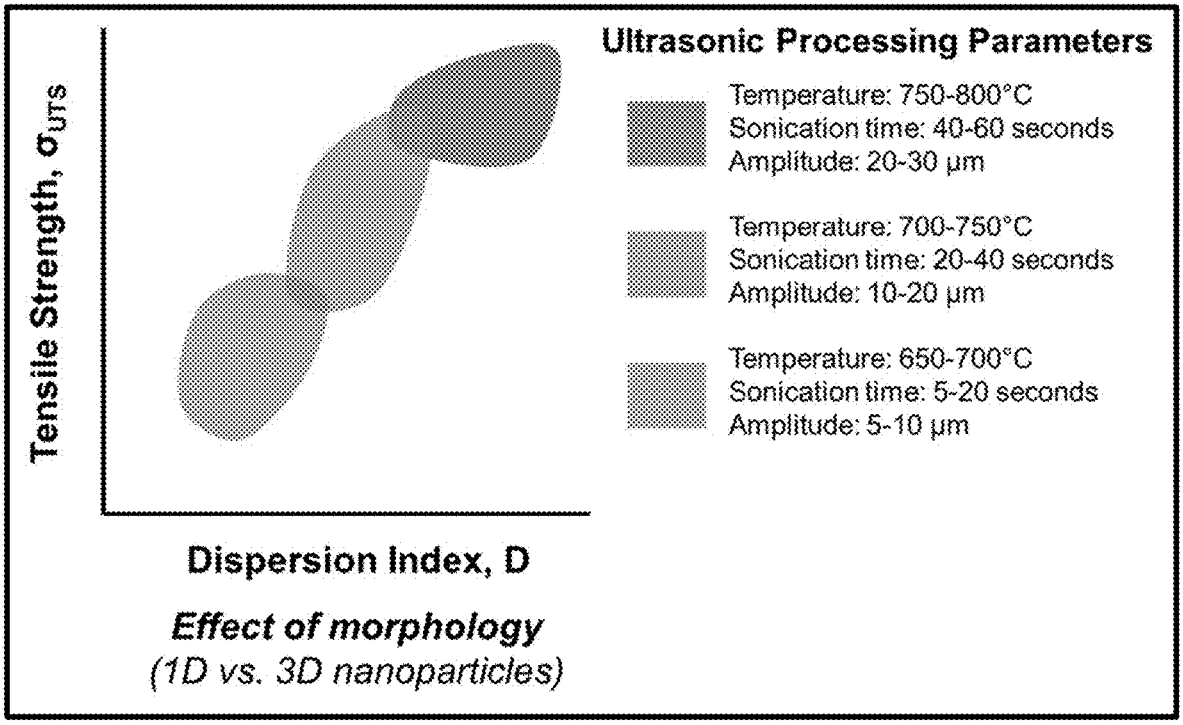
FIG. 11 is a process map showing tensile strength versus dispersion index for different ultrasonic processing parameters. The lower-left shaded region is for the parameters listed on the bottom (e.g., sonication time of 5-20 seconds); the middle shaded region is for the parameters listed in the middle (e.g., sonication time of 20-40 seconds); and the upper-right shaded region is for the parameters listed on the top (e.g., sonication time of 40-60 seconds). The plot shows the effect of morphology (e.g., 1D versus three-dimensional (3D) nanoparticles).

FIG. 11 is a process map showing tensile strength versus dispersion index for different ultrasonic processing parameters. The lower-left shaded region is for the parameters listed on the bottom (e.g., sonication time of 5-20 seconds); the middle shaded region is for the parameters listed in the middle (e.g., sonication time of 20-40 seconds); and the upper-right shaded region is for the parameters listed on the top (e.g., sonication time of 40-60 seconds). The plot shows the effect of morphology (e.g., 1D versus three-dimensional (3D) nanoparticles). Referring to FIG. 11, the tensile strength and dispersion index are higher for higher temperature, longer sonication time, and higher amplitude.

Figure 12:
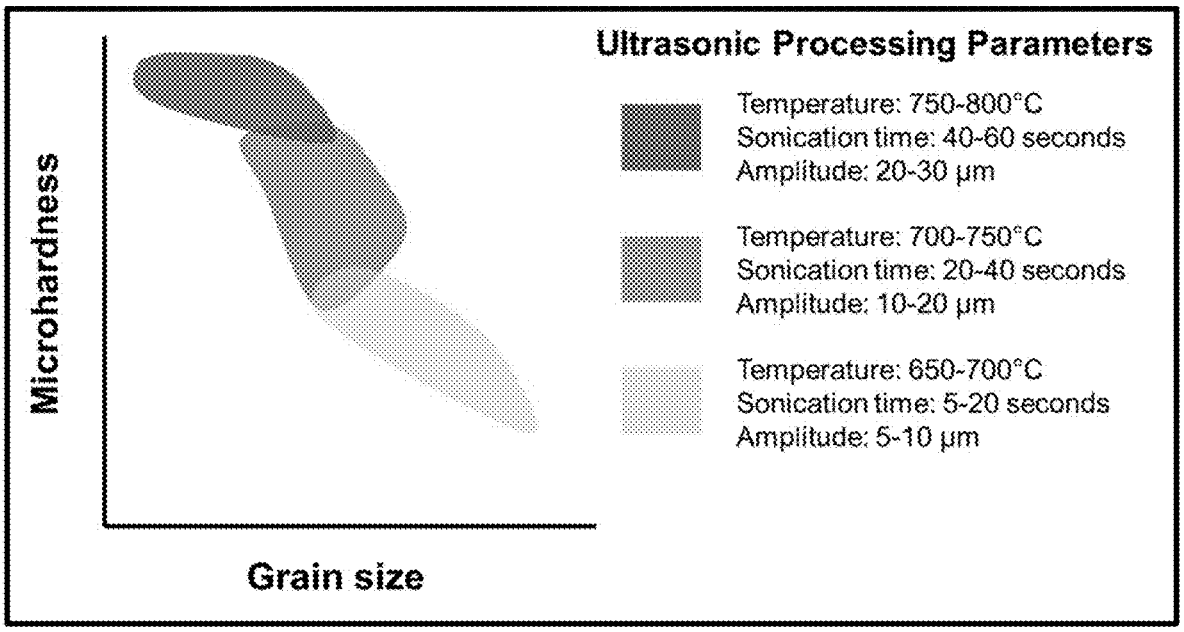
FIG. 12 is a process map showing microhardness versus grain size for different ultrasonic processing parameters. The upper-left shaded region is for the parameters listed on the top (e.g., sonication time of 40-60 seconds); the middle shaded region is for the parameters listed in the middle (e.g., sonication time of 20-40 seconds); and the lower-right shaded region is for the parameters listed on the bottom (e.g., sonication time of 5-20 seconds).

FIG. 12 is a process map showing microhardness versus grain size for different ultrasonic processing parameters. The upper-left shaded region is for the parameters listed on the top (e.g., sonication time of 40-60 seconds); the middle shaded region is for the parameters listed in the middle (e.g., sonication time of 20-40 seconds); and the lower-right shaded region is for the parameters listed on the bottom (e.g., sonication time of 5-20 seconds). Referring to FIG. 12, the microhardness is higher and the grain size is smaller for higher temperature, longer sonication time, and higher amplitude.

Figure 13:
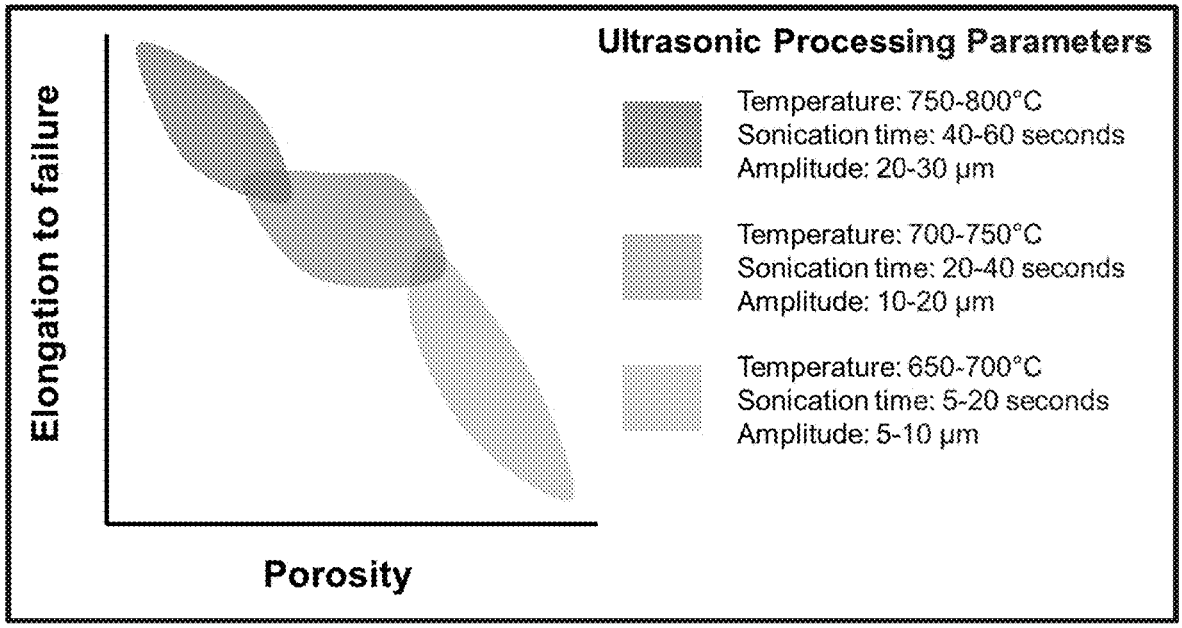
FIG. 13 is a process map showing elongation time to failure (ductility) versus porosity for different ultrasonic processing parameters. The upper-left shaded region is for the parameters listed on the top (e.g., sonication time of 40-60 seconds); the middle shaded region is for the parameters listed in the middle (e.g., sonication time of 20-40 seconds); and the lower-right shaded region is for the parameters listed on the bottom (e.g., sonication time of 5-20 seconds).

FIG. 13 is a process map showing elongation time to failure (ductility) versus porosity for different ultrasonic processing parameters. The upper-left shaded region is for the parameters listed on the top (e.g., sonication time of 40-60 seconds); the middle shaded region is for the parameters listed in the middle (e.g., sonication time of 20-40 seconds); and the lower-right shaded region is for the parameters listed on the bottom (e.g., sonication time of 5-20 seconds). Referring to FIG. 13, the elongation to failure is higher and the porosity is lower for higher temperature, longer sonication time, and higher amplitude.

Fiber reinforcement (e.g., nanotubes) within metal composites strengthens the metal by bearing the applied loads. There is stress transfer at the interface due to shear-lag effect. The nanotubes can bear the stress until they fail. BNNTs in particular have extremely high tensile strength (about 61-64 GPa).

Figure 16:
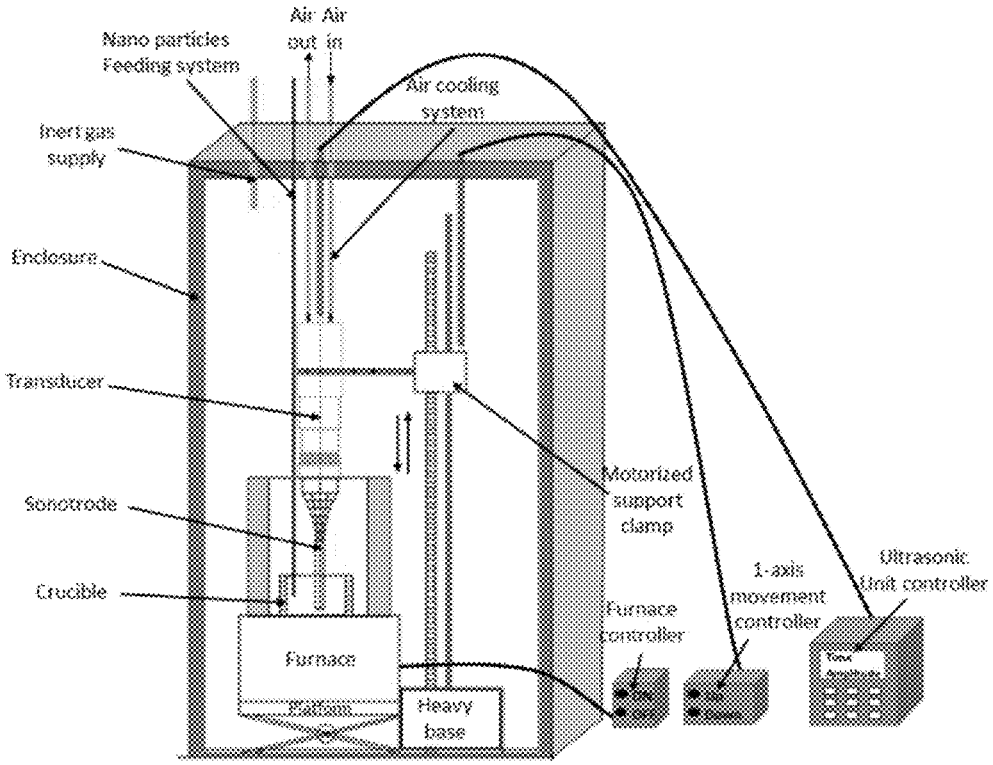
FIG. 16 is a schematic view of an enclosure (e.g., a stainless steel enclosure) that can be used according to embodiments of the subject invention. The enclosure can be flushed with a gas (e.g., an inert gas) to limit oxygen exposure during ultrasonic processing.

FIG. 16 is a schematic view of an enclosure (e.g., a stainless steel enclosure) that can be used according to embodiments of the subject invention. The enclosure can be flushed with a gas (e.g., an inert gas) to limit oxygen exposure during ultrasonic processing. Referring to FIG. 16, the probe-furnace assembly can be placed inside a chamber and flushed with a gas (e.g., an inert gas such as argon) to minimize oxygen exposure and inhibit or prevent metal oxidation during processing. The chamber can be made of, for example, stainless steel with a high-temperature glass front, to allow processing at elevated temperatures for Al, Mg, and other metals (e.g., titanium (Ti)). The sonotrode can be mounted on a motorized support clamp that can be lowered and raised into the melt without opening the chamber, and this can enable positioning of the tip at a precise depth inside the melt. The chamber can have supply/feed lines for a gas (e.g., an inert gas), a cooling gas for the tip, a power supply to the sonotrode, and/or nanoparticle injection into the melt. This can ensure minimal human interaction and atmospheric exposure during the processing, in order to minimize oxidation, contamination, and laboratory safety concerns. Specialized probes for ultrasonic treatment of a melt at variable temperatures and for treating variable volumes can be used. Tips with different geometries can be designed and fabricated to be able to handle Al melt in a broader range of temperature, for example from 550° C. to 900° C. Tips capable of resonating at different temperatures can also be used to be able to process nanocomposites in a wide range of temperatures (see also Table 2). Tips with different diameters can be used to work with variable volumes of materials. In ultrasonic treatment, the volume of interaction depends on the surface area of the tip. For example, a 6 mm diameter tip probe can process up to 100 mL of molten metal, while a 13 mm tip probe can work with larger volumes (e.g., up to 250 mL). The tip of the probe can be corrosion resistant, to have a longer working life and to be able to work at higher temperatures. That is, the probe (and in particular the tip thereof) can be designed and/or chosen depending on the specific operating parameters desired (e.g., temperature and volume).

TABLE 2

Example tip geometries and operating range for ultrasonic processing of Al-based nanocomposites

| Tip material and dimension | Resonant frequency temperature | Operating range of ultrasonic processing |
|---|---|---|
| Niobium (6 mm and 13 mm) | 700° C. | 650-750° C. |
| Niobium (6 mm and 13 mm) | 800° C. | 750-850° C. |
| Unique ceramic tips capable of withstanding elevated temperatures without erosion (6 mm and 13 mm) | 900° C. | 850-950° C. |

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Materials and Methods

An ultrasonic casting setup was prepared and used to fabricate metal-nanoparticle composites as described herein. A furnace capable of reaching up to 1100° C. was also used. The setup included graphite crucibles and an ultrasonic tool (750 Watts) with a niobium (Nb) probe designed for cavitation. The probe, which is shown in FIG. 5, was designed in such a way that it can attain its resonant frequency at the desired operating temperature, which is a function of material properties and the geometry and dimensions of the tip. The special 6 mm Nb tip was modeled and designed for operating in the temperature range of 675-775° C. for the melting of Al-based alloys. The intensity of sound waves introduced into the melt can be controlled by modulating the amplitude of the sonication rod. The ultrasonic convertor was capable of generating vibrations with an amplitude of 16.5 μm at 100% setting. The special Nb tip attached for sonication of the melt had a gain of about 4×. Therefore, the maximum theoretical amplitude that can be attained using the ultrasonic tool is about 66 μm. Varying the amplitude of vibrations can enable modification of the microstructure. The crucible was kept inside a deep furnace, and the sonotrode was inserted inside the crucible for the processing. This set-up limited the exposure to the oxygen.

Example 1—Casting of Al6061 Alloy

Figures 6A, 6B, 6C, 6D:
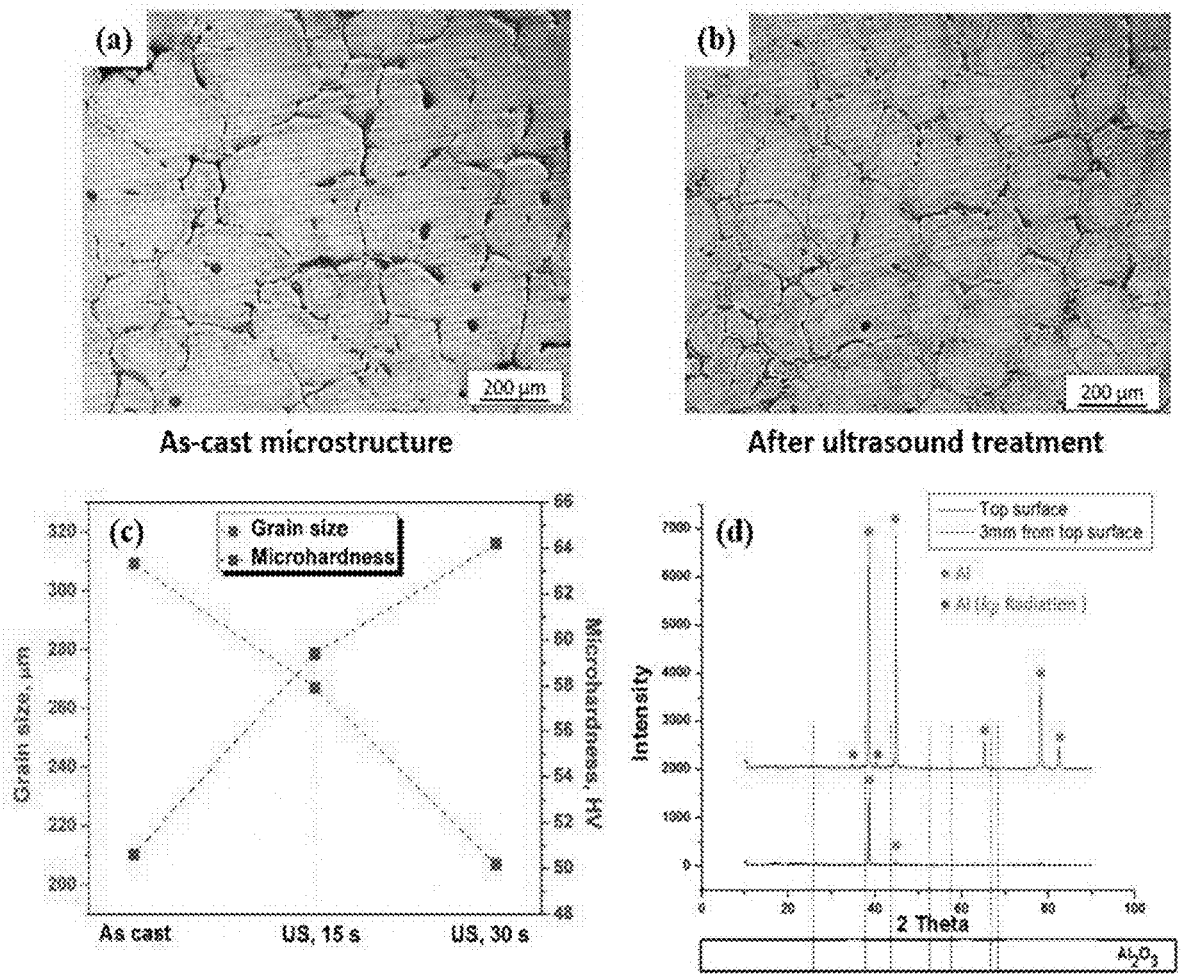
FIG. 6(*a*) is a microscopic image of an aluminum (Al) alloy (Al 6061) as cast, before sonication. The scale bar is 200 micrometers (μm).

Al6061 alloy was used for ultrasonic casting to assess the effect of cavitation on the microstructure, density, and hardness. Ultrasonic treatment resulted in grain refinement (32%) as compared to as-cast microstructure (without sonication), as shown in FIGS. 6(*a*) and 6(*b*). Microhardness increased with the sonication period (28% enhancement after 30 seconds sonication as compared with cast alloy without sonication). Grain sizes and microhardness values for two different sonication periods (15 and 30 seconds) are plotted in FIG. 6(*c*), and are compared with as-cast Al6061. To examine whether there is any oxide formation during the cavitation treatment, X-ray diffraction (XRD) of the cast sample was conducted post-solidification. Both top surfaces, as well as a middle section of the cast pellet, were examined, and no $Al_2O_3$ phase was detected, as shown in FIG. 6(*d*). The standard peak positions for $Al_2O_3$ are marked by the dotted lines in FIG. 6(*d*) for reference, and it can be seen that no oxide was detected by XRD. Therefore, the ultrasonic treatment set-up restricted the oxidation of the Al6061 alloy. Ultrasonic treatment resulted in 100% dense alloy, compared to a 96% density obtained without ultrasonic treatment (in as-cast alloy).

Example 2—Integration of Nanoparticles in Al6061 by Ultrasonic Cavitation

Figures 7A, 7B:
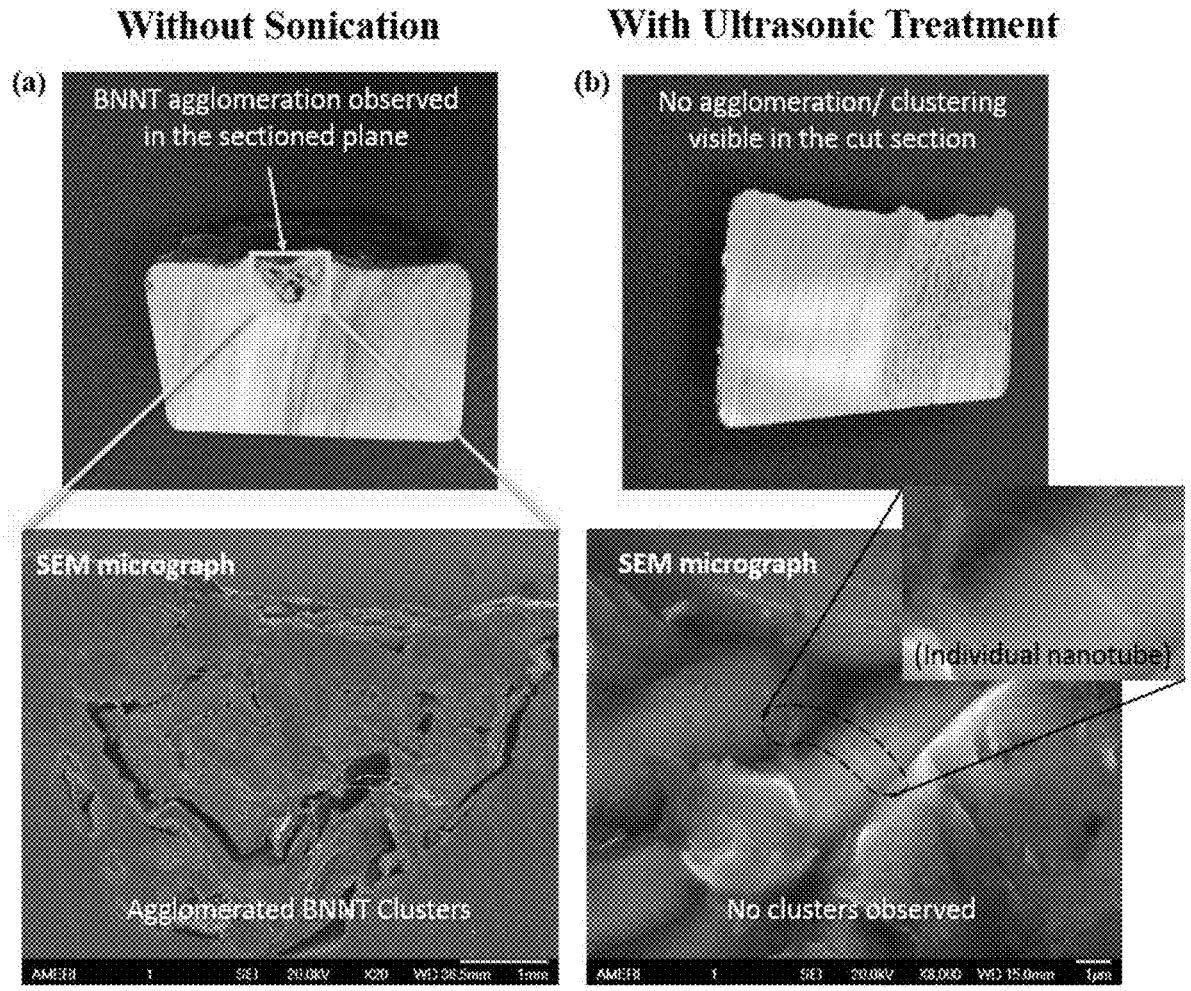
FIG. 7(*a*) is an image and corresponding scanning electron microscope (SEM) micrograph of a sectioned plane of solidified aluminum alloy-boron nitride nanotube (BNNT) composite pellets without sonication. The alloy in this case is Al 6061. The scale bar on the SEM micrograph is 1 mm. The images show BNNT agglomeration.

An Al6061-BNNT composite was synthesized by ultrasonic cavitation. BNNTs were introduced in the melt, wrapped in Al foil. Two such pellets were prepared: one without sonication treatment and one with ultrasonic treatment for 15 seconds at 700° C. at an applied power and amplitude of 700 W and 20 μm, respectively. The solidified pellets were then sectioned from the middle using a low-speed diamond saw. The pellet without sonication treatment revealed a large cluster of BNNTs (FIG. 7(*a*)). The corresponding SEM micrograph of the sectioned surface showed BNNT clusters in the microstructure. However, when ultrasonic treatment was applied to the melt, the cluster was broken, and BNNTs were distributed in the melt. There was no clump observed in the sectioned surface (FIG. 7(*b*)) at the macroscopic scale, and the corresponding SEM image shows the absence of nanotube clustering in the microstructure. An individual nanotube can be seen integrated into the Al matrix (inset of SEM micrograph in FIG. 7(*b*)), verifying sonication assisted dispersion of BNNTs in the melt. These results provide evidence to demonstrate that ultrasonic cavitation leads to the dispersion of nanoparticles in the molten metal.

Example 3—SiC Nanoparticles as the Reinforcement Phase

SiC nanoparticles were used as the reinforcement phase in an Al6061 alloy composite. The composite was prepared as in Examples 1 and 2 and showed good dispersion of the SiC nanoparticles.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A method of fabricating a metal-nanoparticle composite, the method comprising:

preparing a cavity inside a block of a metal;

disposing nanoparticles in the cavity to provide a nanoparticle-metal block;

melting the nanoparticle-metal block to provide a molten material;

stirring the molten material to provide a stirred melt;

ultrasonically treating the stirred melt, by inserting a probe in the stirred melt for a period of time in a range of from 10 seconds (s) to 120 s, to provide an ultrasonically-treated melt; and cooling the ultrasonically-treated melt to provide the metal-nanoparticle composite.

2. The method according to claim 1, the nanoparticles being boron nitride nanotubes (BNNTs).

3. The method according to claim 1, the metal being aluminum (Al) or an Al alloy.

4. The method according to claim 1, the ultrasonically treating of the stirred melt comprising inserting the probe in the stirred melt to ultrasonically treat the stirred melt at a controlled amplitude, the controlled amplitude being in a range of from 10 micrometers (μm) to 30 μm.

5. The method according to claim 4, the ultrasonically treating of the stirred melt comprising inserting the probe in the stirred melt to ultrasonically treat the stirred melt at a controlled frequency for the predetermined period of time, and the controlled frequency being in a range of from 18 kilohertz (kHz) to 20 kHz.

6. The method according to claim 4, a tip of the probe configured to be inserted in the stirred melt having a length in a range of from 4 millimeters (mm) to 8 mm.

7. The method according to claim 1, the melting of the nanoparticle-metal block comprising melting the nanoparticle-metal block in a crucible placed in a furnace at a predetermined temperature.

8. The method according to claim 7, the predetermined temperature being in a range of from 660° C. to 750° C.

9. The method according to claim 1, the nanoparticles being pure nanoparticles that have not undergone any chemical pre-treatment or mechanical pre-treatment prior to being disposed in the cavity.

10. The method according to claim 1, the cavity having a diameter in a range of from 20 mm to 30 mm and a height in a range of from 15 mm to 20 mm.

11. The method according to claim 1, the nanoparticles being disposed in the cavity such that a volume percentage of the nanoparticles in the nanoparticle-metal block is in a range of from 0.5% to 5%.

12. The method according to claim 11, the nanoparticles being disposed in the cavity such that a volume percentage of the nanoparticles in the nanoparticle-metal block is in a range of from 0.5% to 2%.

13. The method according to claim 1, the nanoparticles being boron nitride nanotubes (BNNTs), the metal being Al or an Al alloy.

14. The method according to claim 13, the BNNTs in the metal-nanoparticle composite having an aspect ratio in a range of from 10,000 to 30,000, and the BNNTs being uniformly dispersed within the metal in the metal-nanoparticle composite.

15. The method according to claim 1, the metal being magnesium (Mg) or an Mg alloy.

16. A method of fabricating a metal-nanoparticle composite, the method comprising preparing a cavity inside a block of a metal;

disposing nanoparticles in the cavity to provide a nanoparticle-metal block;

melting the nanoparticle-metal block to provide a molten material;

stirring the molten material to provide a stirred melt;

ultrasonically treating the stirred melt to provide an ultrasonically-treated melt; and cooling the ultrasonically-treated melt to provide the metal-nanoparticle composite, the nanoparticles being boron nitride nanotubes (BNNTs), and the BNNTs in the metal-nanoparticle composite having an aspect ratio in a range of from 10,000 to 30,000.

17. A method of fabricating a metal-nanoparticle composite, the method comprising:

preparing a cavity inside a block of a metal;

disposing nanoparticles in the cavity to provide a nanoparticle-metal block;

melting the nanoparticle-metal block to provide a molten material;

stirring the molten material to provide a stirred melt;

ultrasonically treating the stirred melt to provide an ultrasonically-treated melt; and cooling the ultrasonically-treated melt to provide the metal-nanoparticle composite, the nanoparticles being boron nitride nanotubes (BNNTs), the metal being aluminum (Al) or an Al alloy, the ultrasonically treating of the stirred melt comprising inserting a probe in the stirred melt to ultrasonically treat the stirred melt at a controlled amplitude and a controlled frequency for a predetermined period of time, the controlled amplitude being in a range of from 10 micrometers (μm) to 30 μm, the period of time being in a range of from 10 seconds (s) to 120 s, and the controlled frequency being in a range of from 18 kilohertz (kHz) to 20 kHz, a tip of the probe configured to be inserted in the stirred melt having a length in a range of from 4 millimeters (mm) to 8 mm, the melting of the nanoparticle-metal block comprising melting the nanoparticle-metal block in a crucible placed in a furnace at a predetermined temperature in a range of from 660° C. to 750° C., the nanoparticles being pure nanoparticles that have not undergone any chemical pre-treatment or mechanical pre-treatment prior to being disposed in the cavity, the cavity having a diameter in a range of from 20 mm to 30 mm and a height in a range of from 15 mm to 20 mm, the nanoparticles being disposed in the cavity such that a volume percentage of the nanoparticles in the nanoparticle-metal block is in a range of from 0.5% to 5%, the BNNTs in the metal-nanoparticle composite having an aspect ratio in a range of from 10,000 to 30,000, and the BNNTs being uniformly dispersed within the metal in the metal-nanoparticle composite.

* * * * *